US008598794B2

(12) United States Patent
Lenk

(10) Patent No.: US 8,598,794 B2
(45) Date of Patent: Dec. 3, 2013

(54) WHITE AC LED

(75) Inventor: Ronald J. Lenk, Woodstock, GA (US)

(73) Assignee: Switch Bulb Company, Inc., San Jose, CA (US)

( * ) Notice: Subject to any disclaimer, the term of this patent is extended or adjusted under 35 U.S.C. 154(b) by 263 days.

(21) Appl. No.: 13/062,207

(22) PCT Filed: Oct. 15, 2009

(86) PCT No.: PCT/US2009/005628

§ 371 (c)(1),
(2), (4) Date: May 5, 2011

(87) PCT Pub. No.: WO2010/044866

PCT Pub. Date: Apr. 22, 2010

(65) Prior Publication Data

US 2012/0098443 A1 Apr. 26, 2012

Related U.S. Application Data

(60) Provisional application No. 61/106,031, filed on Oct. 16, 2008.

(51) Int. Cl.
*H05B 37/00* (2006.01)

(52) U.S. Cl.
USPC ..... 315/185 R

(58) Field of Classification Search
USPC ..... 315/185 R
See application file for complete search history.

(56) References Cited

U.S. PATENT DOCUMENTS

| | | | | |
|---|---|---|---|---|
| 6,639,360 | B2 | 10/2003 | Roberts et al. | |
| 7,075,112 | B2 | 7/2006 | Roberts et al. | |
| 7,078,732 | B1 | 7/2006 | Reeh et al. | |
| 7,405,715 | B2 * | 7/2008 | Guzman et al. | 345/83 |
| 7,431,477 | B2 | 10/2008 | Chou et al. | |
| 7,489,031 | B2 | 2/2009 | Roberts et al. | |
| 7,675,249 | B2 * | 3/2010 | Furukawa et al. | 315/309 |
| 7,901,107 | B2 * | 3/2011 | Van De Ven et al. | 362/231 |
| 7,986,107 | B2 | 7/2011 | Weaver et al. | |
| 2001/0038268 | A1 * | 11/2001 | Fuchsberger et al. | 315/291 |
| 2006/0175986 | A1 * | 8/2006 | Lee et al. | 315/312 |
| 2006/0227840 | A1 | 10/2006 | Spoonhower et al. | |
| 2006/0239002 | A1 * | 10/2006 | Chou et al. | 362/249 |
| 2006/0244396 | A1 | 11/2006 | Bucur | |
| 2008/0130285 | A1 * | 6/2008 | Negley et al. | 362/257 |
| 2008/0211416 | A1 * | 9/2008 | Negley et al. | 315/193 |
| 2008/0309255 | A1 * | 12/2008 | Myers et al. | 315/297 |
| 2010/0109557 | A1 | 5/2010 | Bouchard | |
| 2011/0084615 | A1 | 4/2011 | Welten | |
| 2011/0163680 | A1 | 7/2011 | Welten | |
| 2011/0248644 | A1 | 10/2011 | Welten et al. | |

OTHER PUBLICATIONS

Non Final Office Action received for U.S. Appl. No. 12/625,486, mailed on Nov. 14, 2011, 16 pages.
Notice of Allowance received for U.S. Appl. No. 12/625,486, mailed on Jun. 26, 2012, 8 pages.

(Continued)

*Primary Examiner* — Jason M Crawford
(74) *Attorney, Agent, or Firm* — Morrison & Foerster LLP

(57) ABSTRACT

A multi-color white LED which can be driven by a single current, and more particularly, to the use of a specific ratio of numbers of different color LEDs to obtain a specific desired color while running all of them at the same current.

29 Claims, 1 Drawing Sheet

(56) References Cited

OTHER PUBLICATIONS

Non Final Office Action received for U.S. Appl. No. 13/633,054, mailed on Dec. 12, 2012, 6 pages.
Notice of Allowance received for U.S. Appl. No. 13/633,054, mailed on May 24, 2013, 10 pages.
International Search Report and Written Opinion received for PCT Patent Application No. PCT/US2009/005628, mailed on Dec. 10, 2009, 8 pages.
International Preliminary Report on Patentability received for PCT Patent Application No. PCT/US2009/005628, mailed on Apr. 28, 2011, 7 pages.

* cited by examiner

WHITE AC LED

FIELD OF THE INVENTION

The present invention relates to multi-color white LEDs, which can be driven by a single current, and more particularly, to the use of a specific ratio of a plurality of LEDs having a different color spectrum to obtain a desired color and while running each of the LEDs at the same current.

BACKGROUND OF THE INVENTION

Although most LEDs (light emitting diodes) today are devices which run at low voltage, the technology exists to run LEDs directly from a high voltage source, such as an AC (alternating current) line. Two common circuits for running LEDs directly from a high voltage source both place enough LEDs in a series string that their forward voltage at a desired current is approximately equal to that of the AC line voltage. In one circuit technique, two anti-parallel strings are placed directly across the AC line, with one string conducting during the first half line-cycle and the other during the second half. In a second circuit technique, a single string of LEDs is placed after a bridge rectifier, so that the single string of LEDs conducts during both halves of the line-cycle.

In both of these circuit techniques up until now, white LEDs have been created by using a string of white LED dice. It can be appreciated that this works well, if the dice are available to produce the exact shade of white, which is desired. However, in many cases the particular desired white is not available, in which case there is no way to use an AC LED, and designers must go to DC (direct current) LEDs and use complicated and expensive AC/DC converters to run them.

The other method of obtaining white light from LEDs is to use a combination of two or more different color LEDs. This is commonly done in DC LEDs. However, in circuits to date this has been impracticable in AC LEDs, because each LED color must be run at its own current. The reason for this is that to create white light requires a different amount of each LED color. Further, each LED color has different efficacy, the two factors together resulting in each LED color typically being run on its own converter.

Accordingly, it would be desirable to have the ability to select the precise shade of white delivered by an AC LED, which would permit more inexpensive LED lights to be produced for more applications. In addition, it would be desirable to generate arbitrary colored light using AC LEDs rather than needing one or more AC/DC converters.

SUMMARY OF THE INVENTION

In accordance with an exemplary embodiment, one of the objects of this invention is developing a circuit with white or arbitrary light color output, and which provides an AC LED whose light color may be selected by the designer arbitrarily, without requiring one or more AC/DC converters. In accordance with an exemplary embodiment, the circuit includes a specific ratio of a plurality of different color LEDs, the ratio being based on the desired output light color and the efficacy of each color LED. In accordance with an embodiment, the total number of LEDs in the circuit is determined by the forward voltage required to obtain the desired average LED current, factoring in the difference in forward voltage of the different color LEDs. In addition, it can be appreciated that the same current can be run through each of the LEDs, permitting operation as a single string.

In accordance with one embodiment, three colors of LEDs are used, red, green and blue (RGB), and wherein the ratios of the numbers of LEDs of each of the three colors is selected to give the correct output light color, factoring in the efficacy of the individual color LEDs by considering their light output at the same current. In addition, the total number of LEDs is selected to give the appropriate forward voltage to be operated from the AC line, accounting for the differing forward voltage (or forward voltage drop) of each of the differing colors of LEDs.

In accordance with an exemplary embodiment, an LED includes at least two colors of LEDs, a ratio of the at least two colors of LEDs being selected to obtain a desired color spectrum, and wherein all of the at least two colors of LEDs are run in series at the same current. In accordance with another exemplary embodiment, an LED includes a plurality of different color LEDs, which are selected based on a desired output light color and an efficacy of each of the plurality of different color LEDs, and wherein the plurality of different color LEDs are all run in series at the same current.

In accordance with an exemplary embodiment, a method of producing a spectrum of white light from a plurality of color LEDs, includes the steps of selecting at least one LED from at least two colors of LEDs; establishing a ratio of the at least one LED from at least two colors of LEDs to obtain a desired color spectrum; and running the plurality of LEDs in series at a desired current. In accordance with another exemplary embodiment, a method of developing a circuit with white or arbitrary light color output, includes the steps of providing a plurality of color LEDs; establishing a ratio of the plurality of color LEDS based on the desired output light color and efficacy of the each of the selected color LEDs; and running the plurality of color LEDs in series at a desired current. In accordance with a further exemplary embodiment, a method of producing a spectrum of white light from a plurality of LEDs having a different color spectrum, includes the steps of selecting a plurality of LEDs having a different color spectrum; establishing a specific ratio of the plurality of LEDs having a different color spectrum to obtain a desired color; and running the plurality of LEDs having a different color spectrum in series at the same desired current.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
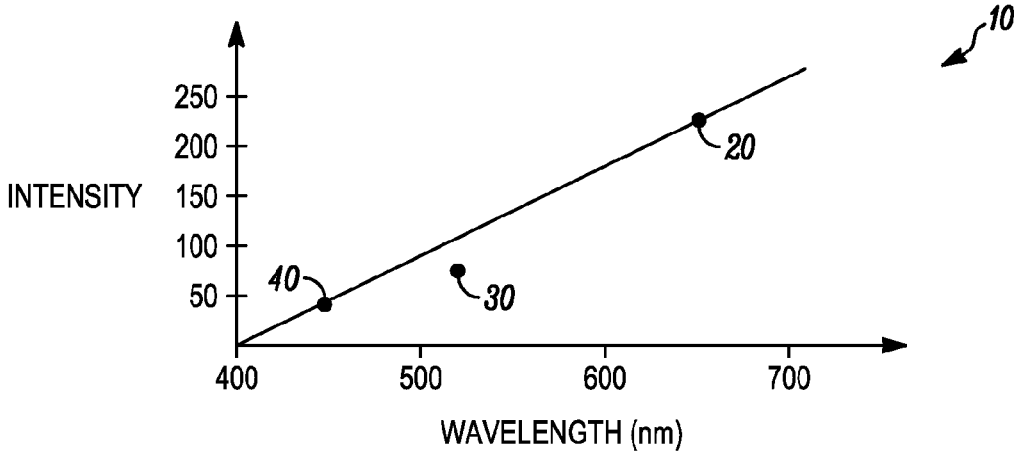
FIG. 1 is a drawing of the spectrum of white light from an incandescent source.

Reference will now be made in detail to the present preferred embodiments of the invention, examples of which are illustrated in the accompanying drawings. Wherever possible, the same reference numbers are used in the drawings and the description to refer to the same or like parts.

According to the design characteristics, a detailed description of the current practice and preferred embodiments is given below.

FIG. 1 is a drawing of a spectrum 10 of white light from an incandescent source. In this drawing, with arbitrary scale, red light 20 at 650 nm is approximately 230 units, green light 30 at 525 nm is approximately 75 units, and blue light 40 at 450 nm is approximately 45 units.

Figure 2:
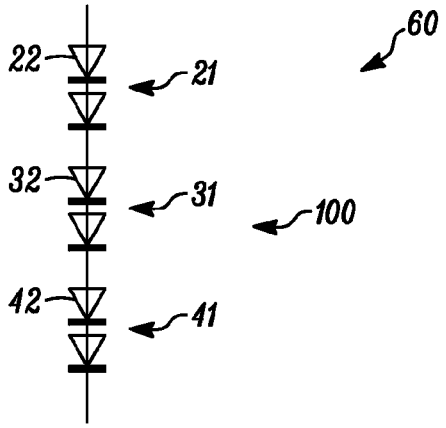
FIG. 2 is a schematic of a circuit that uses a set of RGB (red, green, and blue) LEDs to produce a white AC LED.

FIG. 2 is a schematic of an exemplary circuit 60 that uses a plurality of red LEDs 21, a plurality of green LEDs 31 and a plurality of blue LEDs 41 to produce a white AC LED 100. In accordance with an exemplary embodiment, a red LED 22 typically has a forward voltage (or forward voltage drop) of approximately 2.2V at a specified current, a green LED 32 typically has a forward voltage of approximately 3.4V at the same current, and a blue LED 42 typically has a forward voltage of approximately 3.4V at the same current. In accordance with this exemplary embodiment, a single red LED 22 has a luminous flux of approximately 40 in arbitrary units at this same current, a single green LED 32 has a luminous flux of 52 in the same units at this same current, and a single blue LED 42 has a luminous flux of 15 in the same units at this same current.

In accordance with this exemplary embodiment, the desired ratio of red to green to blue (i.e., R:G:B) LEDs 21, 31, 41 to obtain the spectrum 10 of white light from an incandescent source as shown in FIG. 1 is approximately equal to the following ratio: 230:75:45. In order to achieve this with luminous fluxes in the ratio R:G:B=40:52:15, the LED would have the number of LEDs in the ratio R:G:B equal to approximately (230/40):(75/52):(45/15)=5.75:1.44:3.00≈4:1:2.

In this exemplary embodiment, using 4 (four) red LEDs 21 plus 1 (one) green LED 31 plus 2 (two) blue LEDs 41 in series would produce a forward voltage of 4*2.2V+1*3.4V+2*3.4V=19V. However, in order to achieve a forward voltage of 120V, suitable for the AC line, the number of such sets of LEDs should be approximately 120V/19V≈6. Thus, this gives a total of 24 (twenty-four) red LEDs 21, 6 (six) green LEDs 31 and 12 (twelve) blue LEDs 41. By selecting 7 sets, the total number of LEDs 100 may be made equal to 49, a square number. 49 (forty-nine) LEDs 100 may be made suitable for the AC line by suitable adjustment of the operating current for the circuit. It can be appreciated that circuits 60 with more or less than three colors of LEDs 21, 31, 41 and more or less sets of LEDs can be implemented based on the desired color spectrum.

In addition, the exemplary embodiment as shown in FIG. 2, is only an exemplary embodiment, and that the at least two color LEDs are not limited to red, blue and green LEDs, such that the circuits and methods as described herein can be extended to any color LED or LED having a different color spectrum, and which is capable of producing a desired color spectrum in combination with at least one other color LED. In addition, the parameters for the color LEDs as they pertain to wavelength, forward voltage, and luminous fluxes are only examples, and should not be construed as limiting parameters for those color LEDs or other suitable color LEDs.

Figure 3:
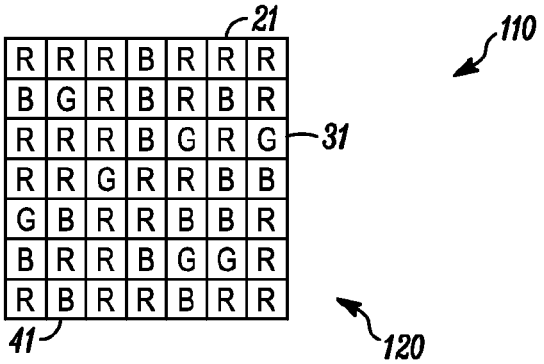
FIG. 3 is a view of a device using RGB (red, green, and blue) LEDs to produce a white AC LED.

FIG. 3 is a view of a device using RGB LEDs to produce a white AC LED 110. In a preferred embodiment, 28 (twenty-eight) red LEDs 21, 7 (seven) green LEDs 31 and 14 blue LEDs 41, which are randomly arranged in a 7×7 die matrix 120. The random arrangement is selected in order to aid mixing of the colors of light. It can be appreciated that the red LEDs 21, green LEDs 31, and the blue LEDs 41 can be randomly arranged in any suitable matrix and is not limited to a 7×7 die matrix 120. For example, the die matrix 120 can be a 3×3, a 5×5, a 7×7, a 9×9, or larger, or can be non-square, for example 6×7.

It will be apparent to those skilled in the art that various modifications and variation can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An LED light source comprising:

a first set of LEDs, the first set comprising one or more LEDs of a first color; and a second set of LEDs, the second set comprising one or more LEDs of a second color, wherein the first color and the second color are different, wherein the number of LEDs in the first set has a ratio to the number of LEDs in the second set, the ratio selected based on the amount of luminous flux emitted by a first LED in the first set at a determined current and the amount of luminous flux emitted by a second LED in the second set at the determined current to obtain a desired color spectrum; and wherein the LEDs in the first and second sets of LEDs are in series.

2. An LED light source as set forth in claim 1, wherein the number of LEDs in the first set and the number of LEDs in the second set are selected to produce a desired forward voltage.

3. An LED light source as set forth in claim 2, wherein the desired forward voltage is an AC line voltage.

4. An LED light source as set forth in claim 1, wherein the first color and the second color are selected from the group comprising red, green, and blue.

5. An LED light source as set forth in claim 1, wherein the LEDs in the first set have a wavelength between approximately 430 nm and 480 nm, wherein the LEDs in the second set have a wavelength between approximately 600 and 630 nm, and wherein the LED light source includes a group of luminophores which are configured to emit light of a wavelength between approximately 555 nm and 585 nm.

6. An LED light source as set forth in claim 1, wherein the desired color spectrum is white.

7. An LED light source as set forth in claim 1, wherein the LEDs in the first and second sets of LEDs are arranged in a matrix.

8. An LED light source as set forth in claim 7, wherein the LEDs in the first and second sets of LEDs are randomly arranged in the matrix.

9. An LED light source comprising:

a plurality of sets of LEDs, each set comprising one or more LEDs of a single color;

wherein the color of the LEDs in each set is different from the colors of the LEDs in other sets, wherein each set has a corresponding value of luminous flux, the value of luminous flux based on the amount of luminous flux emitted by an LED in that set at a determined current, wherein the numbers of LEDs corresponding to the plurality of sets are determined based on a ratio, the ratio based on the values of luminous flux corresponding to the plurality of sets of LEDs to obtain a desired output light color, and wherein the LEDs in the plurality of sets are all in series.

10. An LED light source as set forth in claim 9, wherein the number of LEDs in each set of the plurality of sets is further determined to produce a desired forward voltage.

11. An LED light source as set forth in claim 10, wherein the desired forward voltage is an AC line voltage.

12. An LED light source as set forth in claim 9, wherein a single current is configured to run through the LEDs in the plurality of sets, and wherein the LEDs in the plurality of sets are configured to operate in a single string.

13. An LED light source as set forth in claim 9, wherein each LED in the plurality of sets has a color, and wherein the color is selected from the group comprising red, green, and blue.

14. An LED light source as set forth in claim 9, wherein the plurality of sets of LEDs comprise a first LED and a second LED, wherein the first LED has a wavelength between approximately 430 nm and 480 nm, wherein the second LED has a wavelength between approximately 600 nm and 630 nm, and wherein the LED light source includes a group of luminophores which are configured to emit light of a wavelength between approximately 555 nm and 585 nm.

15. An LED light source as set forth in claim 9, wherein the desired output light color is white.

16. An LED light source as set forth in claim 9, wherein the LEDs in the plurality of sets of LEDs are arranged in a matrix.

17. An LED light source as set forth in claim 16, wherein the LEDs in the plurality of sets of LEDs are randomly arranged in the matrix.

18. A method of producing a spectrum of white light or arbitrary light color from a plurality of LEDs, comprising:

selecting a first set of LEDs, the first set comprising one or more LEDs of a first color;

selecting a second set of LEDs, the second set comprising one or more LEDs of a second color, wherein the second color is different from the first color;

determining the number of LEDs in the first set and the number of LEDs in the second set based on a ratio, the ratio selected based on the amount of luminous flux emitted by a first LED in the first set at a determined current and the amount of luminous flux emitted by a second LED in the second set at the determined current to obtain a desired color spectrum; and running the LEDs in the first and second sets in series.

19. A method as set forth in claim 18, wherein the numbers of LEDs in the first set and the second set are selected to produce a desired forward voltage.

20. A method as set forth in claim 19, wherein the desired forward voltage is an AC line voltage.

21. A method as set forth in claim 18, wherein the first color and the second color are selected from the group comprising red, green, and blue.

22. A method as set forth in claim 18, the method further comprising:

selecting a group of luminophores which are configured to emit light of a wavelength of between approximately 555 nm and 585 nm, wherein the LEDs in the first set have a wavelength between approximately 430 nm and 480 nm, and wherein the LEDs in the second set have a wavelength between approximately 600 nm and 630 nm.

23. A method as set forth in claim 18, wherein the desired color spectrum is white.

24. A method as set forth in claim 18, the method further comprising arranging the LEDs in the first and second sets in a matrix.

25. A method as set forth in claim 24, the method further comprising randomly arranging the LEDs in the first and second sets in the matrix.

26. A method of developing a circuit with white or arbitrary light color output, comprising:

providing a plurality of sets of LEDs, each set comprising one or more LEDs of a single color;

wherein the color of the LEDs in each set is different from the colors of the LEDs in other sets, and wherein each set has a corresponding value of luminous flux, the value of luminous flux based on the amount of luminous flux emitted by an LED in that set at a determined current;

determining the numbers of LEDs corresponding to the plurality of sets based on a ratio, the ratio selected based on the values of luminous flux corresponding to the plurality of sets of LEDs to obtain a desired output light color; and running the LEDs in the plurality of sets in series.

27. A method as set forth in claim 26, the method further comprising:

determining the number of LEDs in each set of the plurality of sets to produce a desirable forward voltage.

28. A method as set forth in claim 26, the method further comprising:

running a single current through the LEDs in the plurality of sets of LEDs, and operating the LEDs in the plurality of sets as a single string.

29. A method as set forth in claim 26, wherein each LED in the plurality of sets has a color, and wherein the color is selected from the group comprising red, green, and blue.

* * * * *